US005314299A

United States Patent [19]

Jacobsson

[11] Patent Number: 5,314,299

[45] Date of Patent: May 24, 1994

[54] SPEED GOVERNOR FOR A PNEUMATIC POWER TOOL

[75] Inventor: Rolf A. Jacobsson, Saltsjö-Boo, Sweden

[73] Assignee: Atlas Copco Tools AB, Nacka, Sweden

[21] Appl. No.: 73,768

[22] Filed: Jun. 8, 1993

[30] Foreign Application Priority Data

Jun. 16, 1992 [SE] Sweden ..... 9201844-9

[51] Int. Cl.[5] ..... F01D 7/02

[52] U.S. Cl. ..... 415/30; 415/37; 137/220

[58] Field of Search ..... 137/220, 219; 251/63.4; 415/37, 40, 202, 30

[56] References Cited

U.S. PATENT DOCUMENTS

| | | | |
|---|---|---|---|
| 824,546 | 6/1906 | Junggren | 415/37 |
| 3,703,339 | 11/1972 | Czuszak | 415/40 |
| 4,285,495 | 8/1981 | King | 137/219 |
| 4,351,353 | 9/1982 | Filidoro et al. | 137/219 |
| 4,606,340 | 8/1986 | Ansite | 251/63.4 |
| 4,651,768 | 3/1987 | Epe | 137/219 |
| 4,721,283 | 1/1988 | Wilson | 251/63.4 |
| 4,747,426 | 5/1988 | Weevers | 137/220 |
| 4,911,196 | 3/1990 | Kemp | 137/220 |

FOREIGN PATENT DOCUMENTS

| | | | |
|---|---|---|---|
| 2152038 | 5/1972 | Fed. Rep. of Germany | 137/200 |
| 2342020 | 3/1974 | Fed. Rep. of Germany | 137/200 |
| 1054190 | 2/1954 | France | 137/219 |

*Primary Examiner*—John T. Kwon

*Attorney, Agent, or Firm*—Frishauf, Holtz, Goodman & Woodward

[57] ABSTRACT

A speed governor for a pneumatic power tool which comprises a housing (10) with pressure air supply means (16–18) and an air turbine (20) including a turbine wheel (22) drivingly coupled to an output spindle and a number of air nozzles (25) for directing motive pressure air onto the turbine wheel (22), wherein the speed governor comprises a flow controlling valve element (43) associated with an activation piston (44) for adjusting the valve element (43) in response to a control pressure obtained in a pressure sensing opening (34) located opposite an idle running nozzle (28) downstream of the turbine wheel (22).

5 Claims, 4 Drawing Sheets

SPEED GOVERNOR FOR A PNEUMATIC POWER TOOL

BACKGROUND OF THE INVENTION

This invention relates to a speed governor for a pneumatic power tool of the type including a housing with a pressure air inlet passage, a rotating output spindle, an air turbine including a turbine wheel drivingly coupled to the output spindle and one or more air nozzles in the housing for directing motive pressure air onto the turbine wheel, wherein the speed governor comprises a valve element arranged to control the pressure air flow through the inlet passage and a valve element activating piston means which is exposed to a speed responsive control pressure.

The problem solved by the invention is to accomplish a simple yet reliable speed governor for a fast rotating pneumatically powered turbine. Practical problems relating mainly to dynamic balancing and frictional wear in connection with fast rotating parts make it very difficult to use mechanical fly weight activated governors of any of the types commonly used on vane motor driven pneumatic tools. Examples of prior art speed governors of this type are illustrated in for instance U.S. Pat. Nos. 2,674,229 and 3,421,414.

Prior art speed governors for air turbine driven tools are described in U.S. Pat. Nos. 3,708,240 and 4,776,752. These governors are intended specifically for small size reaction type turbines, where the motive air flow passes through the rotor and nozzles mounted on the rotor. This type of governor requires a good rotating seal between the turbine wheel and the housing to seal off the motive air inlet passage, and there are some problems to obtain a good dynamic rotor balance when using these known turbine and known governor designs.

In another prior art patent, GB 727,649, there is described an action type air turbine provided with an overspeed control device which instead of mechanical speed responsive means associated with the turbine wheel utilizes a control pressure activated inlet valve to reduce the inlet flow at a certain speed level. In this known device, however, the control pressure is derived from a second medium transported by a pump coupled to the turbine, which arrangement reduces drastically the possible applications of the turbine control means to pump drives.

The object of the present invention is to accomplish an improved speed governor for an air turbine driven power tool wherein the above mentioned problems related to prior art technique are avoided. In particular, the invention intends to accomplish an air turbine speed governor having an air inlet flow controlling valve which is activated by a control pressure derived from the motive air flow without incorporating any corotating mechanical means which would jeopardize the dynamic balance of the turbine wheel.

Other characteristic features and advantages will appear from the claims.

A preferred embodiment of the invention is hereinafter described in detail with reference to the accompanying drawings.

DETAILED DESCRIPTION

Figure 1:
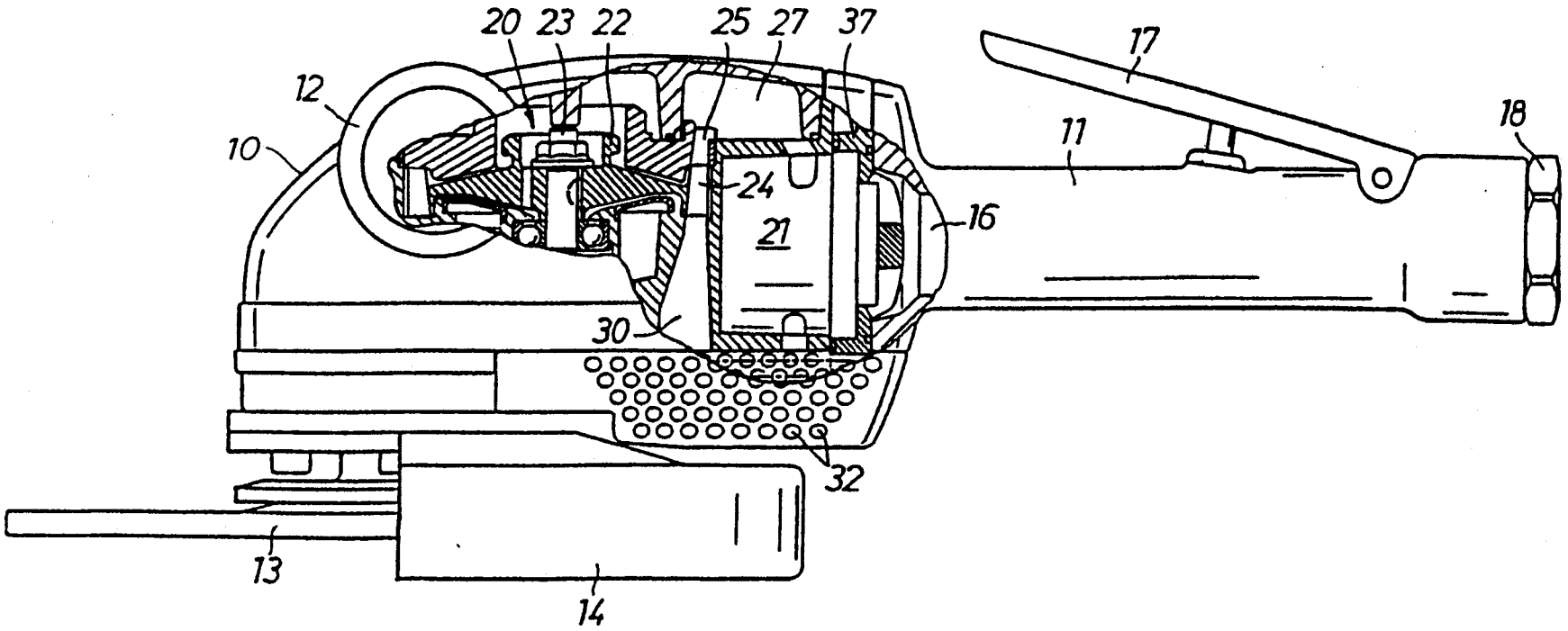
FIG. 1 shows, partly in section, a side elevation of an air turbine driven power tool comprising a speed governor according to the invention.

In FIG. 1 there is shown a pneumatic angle grinder, which comprises a housing 10 provided with two handles 11, 12, an output shaft (not shown) carrying a depressed centre type grinding wheel 13, and a grinding wheel safety guard 14.

One of the handles 11 comprises the pressure air inlet passage 16 of the tool, an inlet valve (not shown) controlled by a lever 17, and a conduit connection 18 for a pressure air supply conduit The tool further comprises a motor in the form of an action type air turbine 20, a speed governor valve unit 21, and a reduction gearing (not shown) coupling the turbine 20 to the output shaft.

Figure 2:
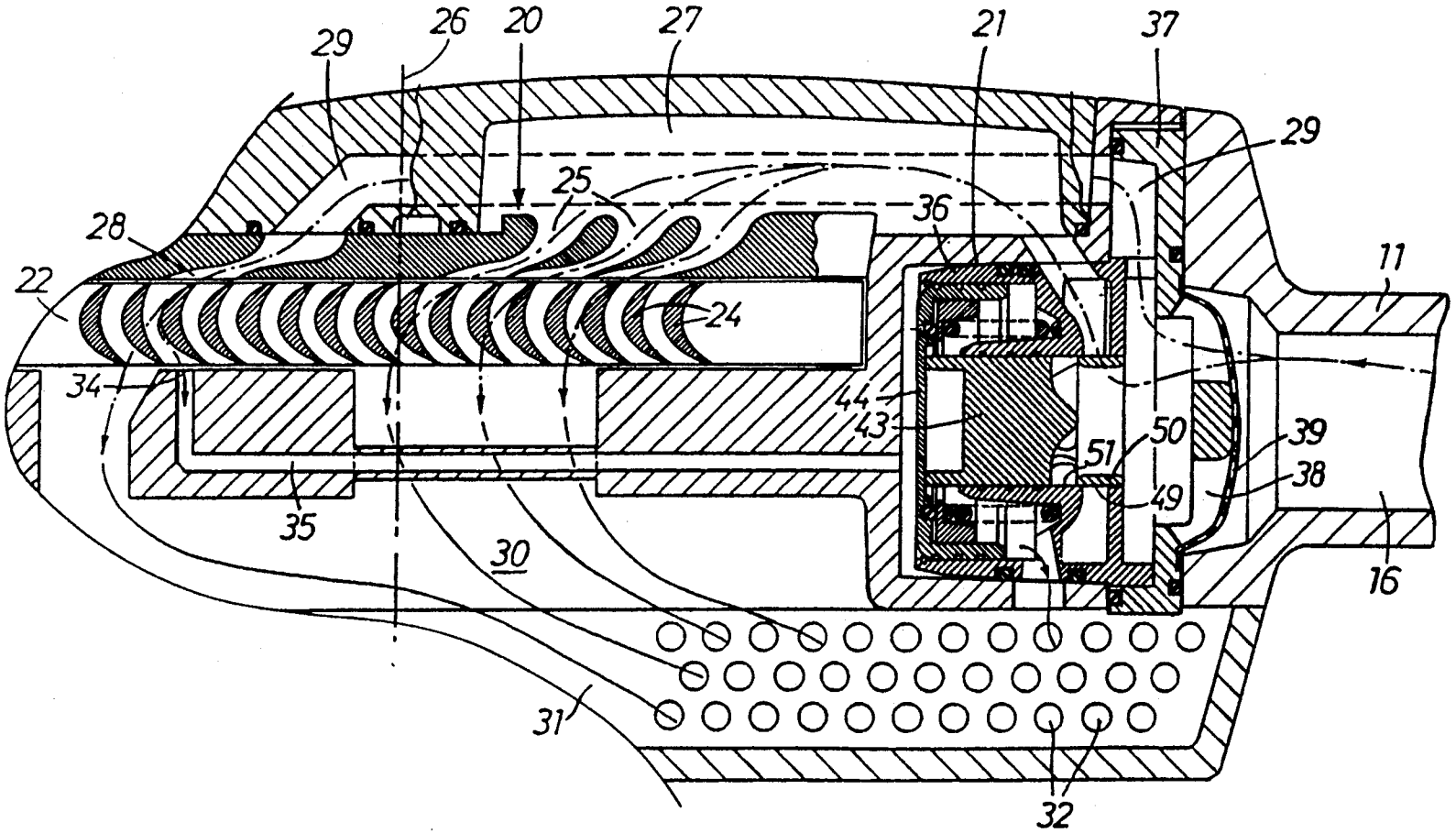
FIG. 2 shows schematically the speed governor arrangement according to the invention including an illustration of the pressure air flow paths through the turbine nozzles and the governor valve.

The turbine 20 consists of a turbine wheel 22 mounted on a shaft 23 and formed with a peripheral row of blades 24, and a number of nozzles 25 for directing motive pressure air onto the turbine wheel blades 24 to rotate the turbine wheel 22 about an axis 26. An air feed passage 27 extends between the speed governor valve 21 and the nozzles 25, and a separate idle running nozzle 28 communicates directly with the inlet passage 16 upstream of the speed governor valve 21 via a passage 29. See FIG. 2. An exhaust air passage 30 extends from the turbine wheel 22 to an outlet and silencing chamber 31 which communicates with the atmosphere through a number of openings 32.

Opposite the idle running nozzle 28 and downstream the turbine wheel 22, there is located a pressure sensing opening 34 which via a control pressure passage 35 communicates with the speed governor valve unit 21.

The speed governor valve unit 21 comprises a casing 36 which is sealingly inserted in the housing 20 and an end cover 37 with inlet openings 38 and a wire net screen 39. The governor casing 36 is formed with two cylindrical bores 41, 42 of different diameters which guidingly supports a valve element 43 and an activating piston 44, respectively. A compression spring 45 acts between the governor casing 36 and a bias ring 46 which abuts against the activating piston 44 via an O-ring 47. The latter covers a pressure relief opening 48 which extends through the piston 44 and acts as a safety valve in case of breakage of the spring 45. The volume between the piston 44 and the casing 36 communicates with the atmosphere through an opening 40.

Figure 3:
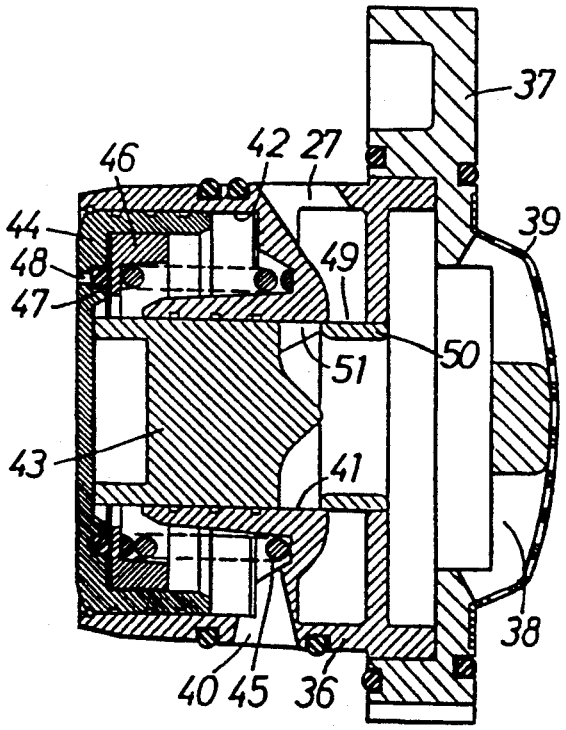
FIG. 3 shows an axial section through the speed governor valve according to the invention. The valve is illustrated in its closed position.
Figure 4:
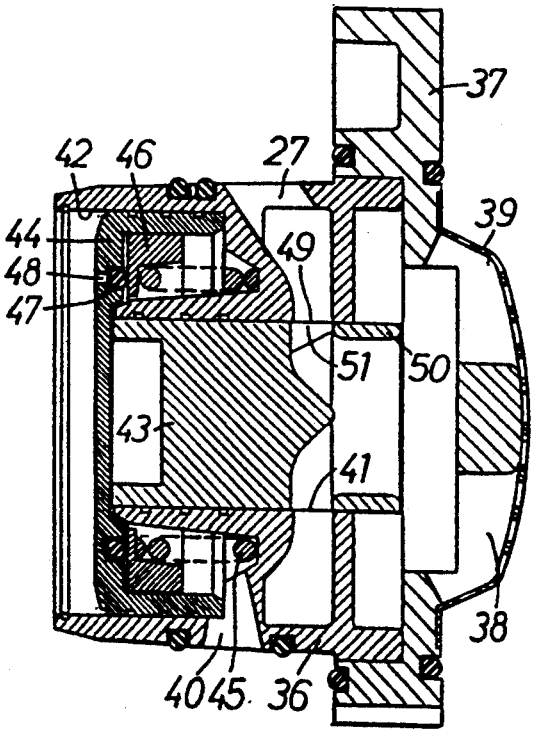
FIG. 4 shows the same section as FIG. 3, but illustrates the valve in its fully opened position.

The bore 41 in the governor casing 36 has a number of lateral openings 49 which form parts of the air feed passage 27 and which are controlled by a tubular skirt portion 50 of the valve element 43. This skirt portion has a number of radial openings 51 which are located at a distance from the outer end of the skirt portion 50 that is bigger than the axial extent of the openings 49. This is to ensure that the openings 49 are fully covered by the skirt portion 50 as the valve element 43 occupies its closed position as illustrated in FIG. 3.

In operation of the tool, pressure air is supplied through the inlet passage 16 at opening of the inlet valve by means of lever 17. When having passed the screen 39 and the openings 38, the air flow is divided into two separate paths, one entering the skirt portion 50 of the governor valve element 43 and another extending through the passage 29 past the governor valve 21 and further up to the idle running nozzle 28. See FIG. 2. Due to the action of spring 45 the valve element 43 occupies its closed position at the initial starting moment. However, the air flow leaving the idle running nozzle 28 passes through the turbine wheel blades 24 and makes the turbine wheel 22 start rotating. Due to a low rotation speed the idle running flow hits the pressure sensing opening 34 and generates a control pressure in the passage 35. See FIG. 2. This results in a force being built up on the activating piston 44, a force that is large enough to move the valve element 43 to open position against the joint force of the spring 45 and the inlet air pressure acting on the valve element 43. Now, the main flow which enters the valve element skirt portion 50 passes through the radial openings 51 which are aligned with the openings 49 in the governor casing 36, extends through the feed passage 27 and reaches the main nozzles 25. This makes the turbine wheel 22 accelerate and very rapidly reach its intended operating speed level.

As the rotation speed level of the turbine wheel 22 increases the idle flow through the turbine wheel blades 24 changes its direction such that most of it hits the exhaust passage 30 directly and the pressure in the pressure sensing opening 34 decreases. This means that the control pressure acting on the piston 44 no longer is able to maintain the fully open position of the valve element 43 against the joint force of the spring 45 and the inlet air pressure but allows the valve element 45 to move in its closing direction. Thereby, the openings 51 on the valve element 43 move out of full alignment with the openings 49 in the governor casing 36 such that the air feed through passage 27 is restricted.

It is to be understood that for the desired speed level there is obtained a balanced position of the valve element 43 such that the air feed flow to the main nozzles 25 is large enough just to maintain the turbine wheel rotation speed at the desired level.

Should the turbine speed tend to decrease due to an increased torque load on the output shaft of the tool, the flow from the idle running nozzle 28 would change direction and cause an increased pressure in the pressure sensing opening 34 which would generate an incresed control pressure load on the activation piston 44 as well as on the valve element 43. The result would be a slight valve element movement in the opening direction of the latter and a subsequent increased flow to the main nozzles 25.

Figure 5:
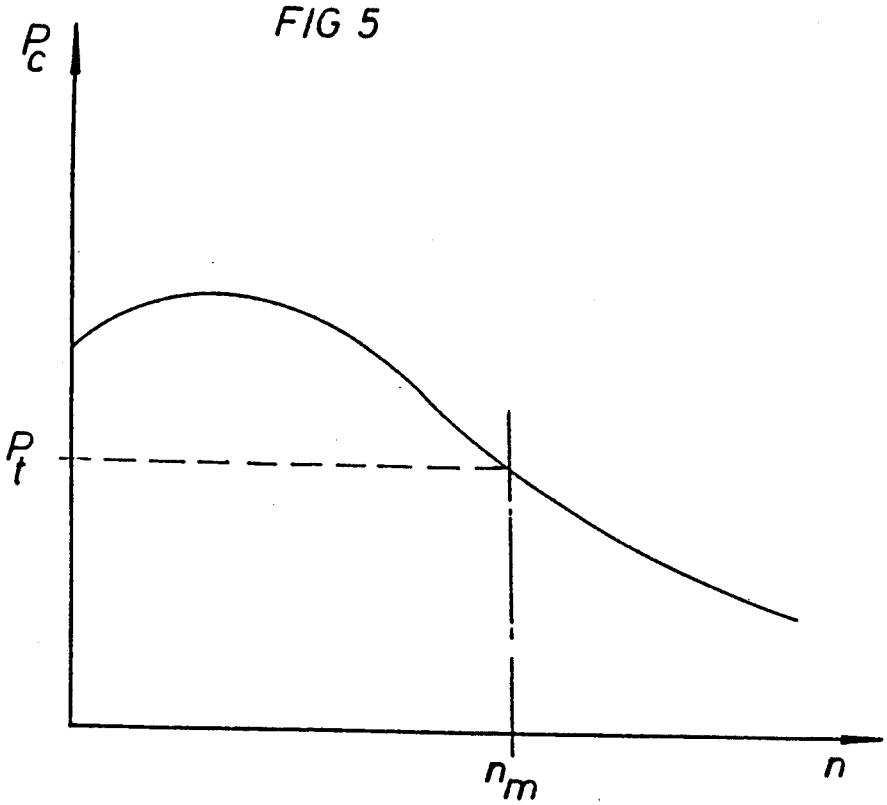
FIG. 5 shows a diagram illustrating the change in control pressure at changing rotation speed.

In FIG. 5 there is illustrated the relationship between the rotation speed n and the obtained control pressure $P_c$ in the pressure sensing opening 34.

The desired operating speed level $n_m$ corresponds to a control pressure $P_c = P_t$.

Figure 6:
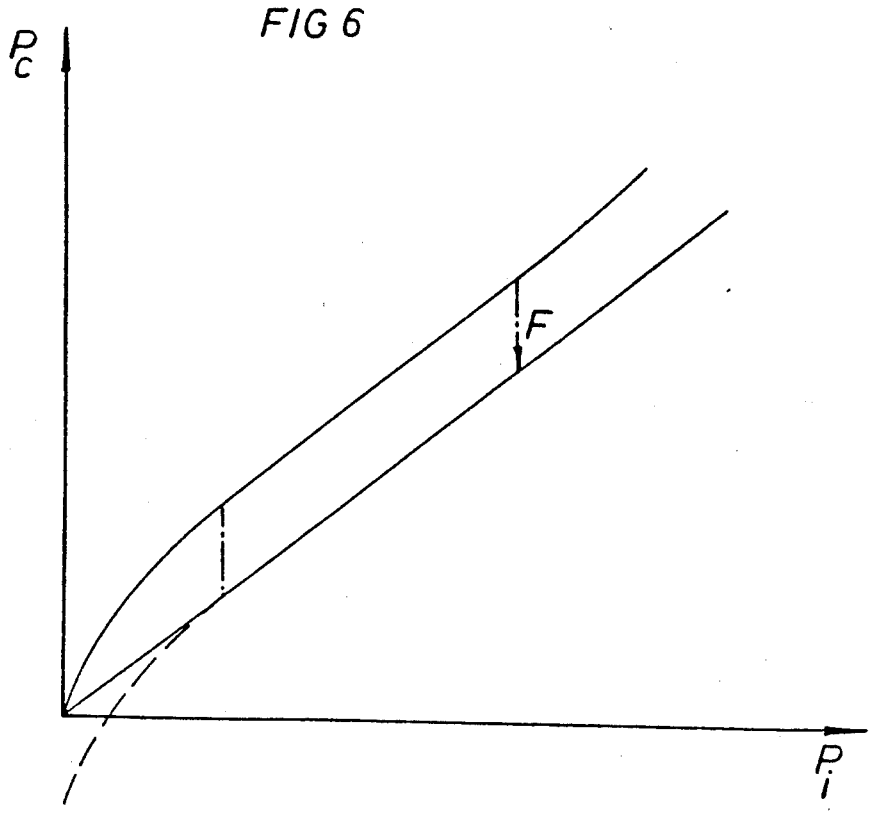
FIG. 6 shows a diagram illustrating the relationship between the air pressure upstream the governor valve and the control pressure acting on the latter at a certain speed level.

In FIG. 6, there is illustrated the action of the valve loading spring 45. It is of significant importance for obtaining a satisfactory operation of the governor valve unit 21 that there is a direct proportionality between the force exerted on the valve element 43 by the inlet pressure $P_i$ and the force accomplished by the control pressure $P_c$ acting on the piston 44. The upper curve in the diagram shows a situation where no spring is employed, whereas the lower curve illustrates the situation when a spring is used. It is to be seen in the diagram that the main part of the lower curve illustrates a direct proportionality since the curve may be extrapolated through origo of the diagram. The difference between the two curves illustrates the force F exerted by the spring 45 onto the activation piston 44.

To increase safety against malfunction of the governor valve unit 21 in case of breakage of the spring 45, the O-ring 47 is arranged to uncover the pressure relief opening 48 as a result of a discontinued contact pressure of bias ring 46. As the opening 48 is uncovered the control pressure from the passage 35 is evacuated through the opening 40 and the piston 44 remains inactive. The valve element 43 will be kept in its fully closed position by the load of the inlet pressure prevailing in passage 16, and the turbine 20 will be rotated by the idle running nozzle flow only. Then, the rotation speed will not reach the intended operating speed.

I claim:

1. In a speed governor for a pneumatic power tool including a housing (10) with a pressure air inlet passage (16), a rotating output spindle, an air turbine (20) including a turbine wheel (22) drivingly coupled to said output spindle and one or more air nozzles (25) in said housing (10) for directing motive pressure air onto said turbine wheel (22), said speed governor comprising a valve element (43) arranged to control the pressure air flow through said inlet passage (16) and a valve element (43) activating piston means (44) exposed to a speed responsive control pressure, the improvement comprising:

a separate idle running nozzle (28), an idle flow supply passage (29) extending from said air inlet passage (16) to said idle running nozzle (28), a control pressure passage (35), and a pressure sensing opening (34) located substantially opposite said idle running nozzle (28) downstream of said turbine wheel (22), said control pressure passage (35) connecting said pressure sensing opening (34) with said piston means (44) so as to make said piston means (44) activate said valve element (43) in response to said turbine speed responsive control pressure prevailing in said pressure sensing opening (34).

2. Governor according to claim 1, wherein said piston means (44) is biassed toward its inactive position by a spring means (45), and, in operation of the tool, said valve element (43) is balanced between the inlet pressure upstream of the speed governor and a control pressure related force acting on said piston means (44) less the bias force of said spring means (45).

3. Governor according to claim 2, wherein said air inlet passage (16) comprises a cylindrical portion (41) with one or more lateral openings (49), and said valve element (43) is slidably guided in said cylinder portion (41) to control the air flow through said one or more lateral openings (49) in response to said speed responsive control pressure.

4. Governor according to claim 3, wherein said valve element (43) comprises a skirt portion (50) having one or more radial apertures (51) which are arranged to coincide with said lateral openings (49) as said valve element (43) occupies its fully open position, said apertures (51) being located at a distance from a free end of said skirt portion (50) that is larger than the axial extent of said lateral openings (49).

5. Governor according to claim 2, wherein said piston means (44) comprises a safety valve means (46–48) which is biassed toward a normally closed position by said spring means (45), said safety valve means being arranged to open automatically to relieve said control pressure acting on said piston means (44) in case of breakage of said spring means (45).

* * * * *

UNITED STATES PATENT AND TRADEMARK OFFICE

CERTIFICATE OF CORRECTION

PATENT NO. : 5,314,299
DATED : 24 May 1994
INVENTOR(S) : Rolf Alexis JACOBSSON

It is certified that error appears in the above-indentified patent and that said Letters Patent is hereby corrected as shown below:

In the Title Page, under item, [56] References Cited, U.S. PATENT DOCUMENTS, insert --2,674,229 4/1954 Karlen 3,421,414 1/1969 Peale 3,708,240 1/1973 Theis, Jr.

4,776,752 10/1988 Davis--;

under item: [56] References Cited, FOREIGN PATENT DOCUMENTS, insert --727,649 4/1955 Great Britain--.

Signed and Sealed this

Sixteenth Day of July, 1996

*Attest:*

*Attesting Officer*

Bruce Lehman

BRUCE LEHMAN

*Commissioner of Patents and Trademarks*